US007392673B2

(12) United States Patent
Fawcett et al.

(10) Patent No.: US 7,392,673 B2
(45) Date of Patent: Jul. 1, 2008

(54) LOCK MECHANISM FOR DISPLAY ROD

(75) Inventors: Christopher J. Fawcett, Charlotte, NC (US); Ronald M. Marsilio, Lake Wiley, SC (US); Keith C. Nagelski, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 11/799,375

(22) Filed: May 1, 2007

(65) Prior Publication Data

US 2007/0289344 A1 Dec. 20, 2007

Related U.S. Application Data

(60) Provisional application No. 60/814,655, filed on Jun. 16, 2006.

(51) Int. Cl.
*E05B 73/00* (2006.01)
*E05B 47/00* (2006.01)

(52) U.S. Cl. ..... 70/14; 70/57.1; 70/62; 70/276; 70/413; 211/7

(58) Field of Classification Search ..... 70/14, 70/18, 19, 57, 58, 61, 57.1, 62, 63, 276, 413; 211/4, 7, 54.1, 57.1, 59.1; 248/551–553, 248/220.21, 220.31, 220.41, 220.42, 220.43, 248/221.11, 225.11; 340/572.9
See application file for complete search history.

(56) References Cited

U.S. PATENT DOCUMENTS 892,407 A 7/1908 Courtney et al.
3,918,278 A 11/1975 Spear
4,063,646 A 12/1977 Stahl, Jr.
4,289,242 A 9/1981 Kenyon
4,351,440 A 9/1982 Thalenfeld
4,889,304 A 12/1989 Glickman et al.
5,027,622 A 7/1991 Hatch et al.
5,259,220 A 11/1993 Fredrickson
5,275,027 A 1/1994 Eklof et al.
5,348,167 A 9/1994 Jensen
5,676,258 A 10/1997 Leyden et al.
5,689,978 A 11/1997 Eklof et al.
6,003,685 A 12/1999 Malin
6,311,531 B1 11/2001 Sykes (Continued)

*Primary Examiner*—Lloyd A. Gall
(74) *Attorney, Agent, or Firm*—Sand & Sebolt

(57) ABSTRACT

A lock mechanism is mounted on a pair of vertically spaced merchandise display rods to prevent removal of items of merchandise supported on the lower rod. The lock mechanism includes a housing having a internal lock chamber and a pair of upper and lower slots, each receiving one of the rods therethrough. The lower slot has a side opening enabling the lower rod to pass out of the housing when the housing is pivotally moved on the upper rod to an unlocked open position. A bayonet is slidably moveable in the chamber of the housing and has an elongated slot through which both of the rods extend. A locking device has a magnetically attractable locking tine which locks the housing and bayonet in a closed locked position on the pair of rods. A magnetic key moves the tine to an unlocked position enabling the housing and bayonet to move to an unlocked open position exposing the side opening of the housing lower slot for removing the housing out of engagement with the lower rod.

15 Claims, 18 Drawing Sheets

U.S. PATENT DOCUMENTS 6,364,124 B1 4/2002 Chen
6,474,478 B1 11/2002 Huehner et al.
6,601,808 B1 8/2003 Nagel
6,622,979 B2 9/2003 Valiulis
6,659,291 B2 12/2003 Huehner et al.
6,848,285 B2 * 2/2005 Stroh ..... 70/57.1
6,957,555 B1 10/2005 Nagel et al.
7,007,810 B2 * 3/2006 Huehner et al. ..... 211/57.1
7,131,542 B2 * 11/2006 Sedon et al. ..... 211/59.1
7,269,983 B1 * 9/2007 Mchatet et al. ..... 70/14
2005/0029205 A1 * 2/2005 Mansfield et al. ..... 211/7
2006/0021394 A1 * 2/2006 Belden, Jr. ..... 70/57.1
2006/0157431 A1 * 7/2006 Nagelski et al. ..... 211/54.1
2007/0062890 A1 * 3/2007 Nagelski et al. ..... 211/57.1

* cited by examiner

LOCK MECHANISM FOR DISPLAY ROD

CROSS REFERENCE TO RELATED APPLICATIONS

This application claims priority from U.S. Provisional Application Ser. No. 60/814,655 filed Jun. 16, 2006; the disclosure of which is incorporated herein by reference.

BACKGROUND OF THE INVENTION

1. Technical Field

The present invention relates to security devices, and particularly to a security device that prevents large numbers of items of merchandise from being rapidly removed from display racks, and in particular from a double display rod. Specifically, the present invention relates to a security device that is easily attached and locked on the display rod and which allows one or several items of merchandise to be removed from the rod at any one time, but protects a number of the items from being removed from the rod by a shoplifter, and that can only be unlocked using a specially configured magnetic key.

2. Background Information

Numerous items of merchandise are displayed for sale on long protruding rods that are supported from a piece of pegboard, slat board, or other type of supporting structure. These rods are commonly referred to in the art as pegboard rods or slat board rods. Many items of merchandise such as batteries, small tools, tool components, film, or other relatively expensive small items are displayed in areas where consumers may pick them up and take them directly to a checkout counter. These items usually are suspended on the rods by the rod passing through a single hole in the package. Unfortunately, such merchandise is an easy target for shoplifters. It has been found that shoplifters can rapidly empty all of the merchandise from a pegboard display rod and make off with merchandise without being detected, or even if detected upon passing through a checkout security gate, will be difficult to apprehend.

Various devices have been devised to prevent the removal of merchandise from these display rods such as shown in U.S. Pat. Nos. 5,027,622, 5,275,027, 5,259,220, 5,689,978, 5,676,258, 6,622,979, and 6,474,478. The devices of these patents provide for some type of locking mechanism on the end of the rod preventing the removal of any items of merchandise from the rod. This has the disadvantage in that it requires the customer to contact a clerk who must unlock the lock mechanism from the end of the rod to enable the customer to remove the merchandise for purchase. It has been found that this reduces the amount of sales since many customers do not wish to wait or take the time to find a clerk to unlock the security device to enable the customer to secure the desired item.

Other types of display rods use irregularly shaped ends on the rod which enables the customer to remove the item from the rod by moving it through a circuitous route along various bends at the distal end of the rod. This has proven satisfactory to some extent in that it increases the difficulty of a shoplifter from rapidly removing a large number of the items from the rod. However, it does not prevent the shoplifter from removing all of the items of merchandise from the rod if the shoplifter uses a large amount of force upon sweeping the items from the rod or bunches the items together enabling a plurality of the items to be removed in one motion from the rod.

Another disadvantage with display rods is that a thief will occasionally remove the entire rod from the supporting structure or peg board including the merchandise even if secured on the rod and steal the contents from the store. Therefore, to prevent the theft of the entire display rod and supported merchandise, devices have been developed to lock the display rod to the supporting structure.

Another problem with prior art rod locking devices is that they require more manipulation than desirable in order to attach the lock device on the rod or remove the same from the rod and when in multiple components, the components can be separated and lost.

Certain types of merchandise security devices use magnetic actuated locks which use a magnetic key to unlock the lock. However, thieves have discovered that certain types of magnetic locks can be unlocked by commonly available bar magnets, thus making these locks less desirable for merchants.

Many types of merchandise display rods consist of a pair of upper and lower rods which extend in parallel with respect to each other from a support structure with the merchandise being supported on the lower rod. The upper rod supports an article identification tag identifying the item of merchandise stored on the lower rod. In these double rod arrangements, a lock is usually placed on the lower rod in order to protect the merchandise supported thereon. However, the presence of the closely spaced upper rod makes it more difficult to attach, remove and unlock the security device on the lower rod. Thus, these double display rod arrangements increase the difficulty for conveniently placing and removing a lock mechanism thereon to prevent the theft and rapid removal of the merchandise from the lower rod.

Thus, it is desired in the art to provide a security device for double display rods so that large quantities of merchandise cannot be rapidly removed from the rods yet would allow legitimate customers to remove a limited number of the items from the rod without requiring a merchant or store clerk to assist the customer, and to prevent the double display rods from being unlawfully removed from the supporting structure, and if removed will sound an alarm of a security gate upon passing through the gate in an unauthorized manner.

BRIEF SUMMARY OF THE INVENTION

The present invention provides a security device for double display rods that prevents the rapid removal of a large number of the displayed items of merchandise from the display rods, which rods extend outwardly from a support structure in a space parallel relationship, by placing a simple, compact, yet highly effective locking device on a linear length of the pair of display rods, preferably located between a number of the items stored on the lower rod. This will enable those items located between the security device and the distal end of the lower display rod to be removed by a customer yet prevents any removal of those items between the support structure and locking device until a clerk unlocks the security device and repositions it behind a number of the already stored items, or places new items inbetween the security device and distal end of the rod for subsequent removal by the customer.

Another aspect of the present invention is to provide the display rod security device as a simple two-piece component which when slidably joined together trap the devices on the spaced rods, which when in a closed locked position form a pair of openings through which the display rods extend, and which has a sufficient linear length and opening configurations to prevent the lock device from being removed from a bent end of one of the display rods.

Another aspect of the present invention is to provide one of the components which forms a lower housing of the security device with at least one or a pair of spring biased tines which automatically snap into locking engagement with locking recesses formed in the other of the components when the two components are moved to a closed position.

Another feature of the present invention is to form the locking tines of a magnetically attractable material whereby a magnetic key when placed at a specific location on the lock mechanism, will move the tines to the unlocked position enabling the security device to be easily moved to an unlocked position and then pivoted on the upper rod to a disengaged position from the lower rod enabling the placement and removed of merchandise from the lower rod.

A further feature is that the lock mechanism includes a shaped recess that requires a complementary-shaped magnetic key to unlock the internal locking mechanism rendering certain types of common bar magnets ineffective in unlocking the lock mechanism, and in which the magnetic key is a dipole magnet providing a stronger magnet with a unique configuration.

A further aspect of the present invention is to form the two components inexpensively of rigid plastic material which is strong enough to prevent a thief from easily prying the two components apart, and which enables the lock mechanism to be mass produced relatively inexpensive encouraging the use thereof by merchants to reduce shoplifting.

Another aspect of the present invention is to enable the two components to remain assembled once snap fitted onto the upper rod preventing subsequent loss of the lock device from the display rods, and in which the magnetic key once unlocking the locking tines can be used to partially separate the two components whereupon the lower housing can be pivoted out of engagement from the lower rod for subsequent placement and removal of merchandise onto and from the lower rod.

Still another feature of the present invention is to provide the double rod display assembly with a locking device to lock the rods onto the supporting structure to prevent removal of the pair of rods unlawfully from the supporting structure by a thief.

A further aspect of the present invention is to provide the distal end of the upper rod with a display tag to provide the customer with a visual indication of the item of merchandise stored on the lower rod and/or price of the merchandise or other features thereof.

Another aspect of the present invention is to provide the lower rod with a irregularly shaped distal end providing an anti-sweep feature to the end of the rod making it difficult for removing more than one of the unsecured items of merchandise from the rod at one time.

Still another feature is to provide the lock mechanism with a concealed EAS tag which will sound a security gate alarm should a thief attempt to remove the entire display rod and attached lock mechanism from a secured area.

These features and advantages are obtained by the lock mechanism of the present invention, which lock mechanism is attached to a pair of rods extending outwardly from a merchandise display support structure, wherein the lock mechanism comprises a housing having an internal lock chamber and formed with a pair of openings for receiving the pair of rods therethrough; a locking bayonet slidably mounted in the lock chamber and formed with an elongated slot for trapping the pair of rods in the openings of the housing; a locking mechanism including at least one magnetically attractable locking tine located within the lock chamber of the housing to secure the housing and bayonet in a locked position on a linear part of the rods; a slot formed in the housing and communicating with the lock chamber and one of the openings through which the lower rod extends, said bayonet blocking the slot when in the locked position and exposing the slot when in an unlocked open position enabling the lock mechanism to pivot about the upper rod with the lower rod being moveable through the slot to disengage the lock mechanism from the lower rod.

BRIEF DESCRIPTION OF THE SEVERAL VIEWS OF THE DRAWINGS

Preferred embodiments of the invention, illustrated of the best mode in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Figure 1:
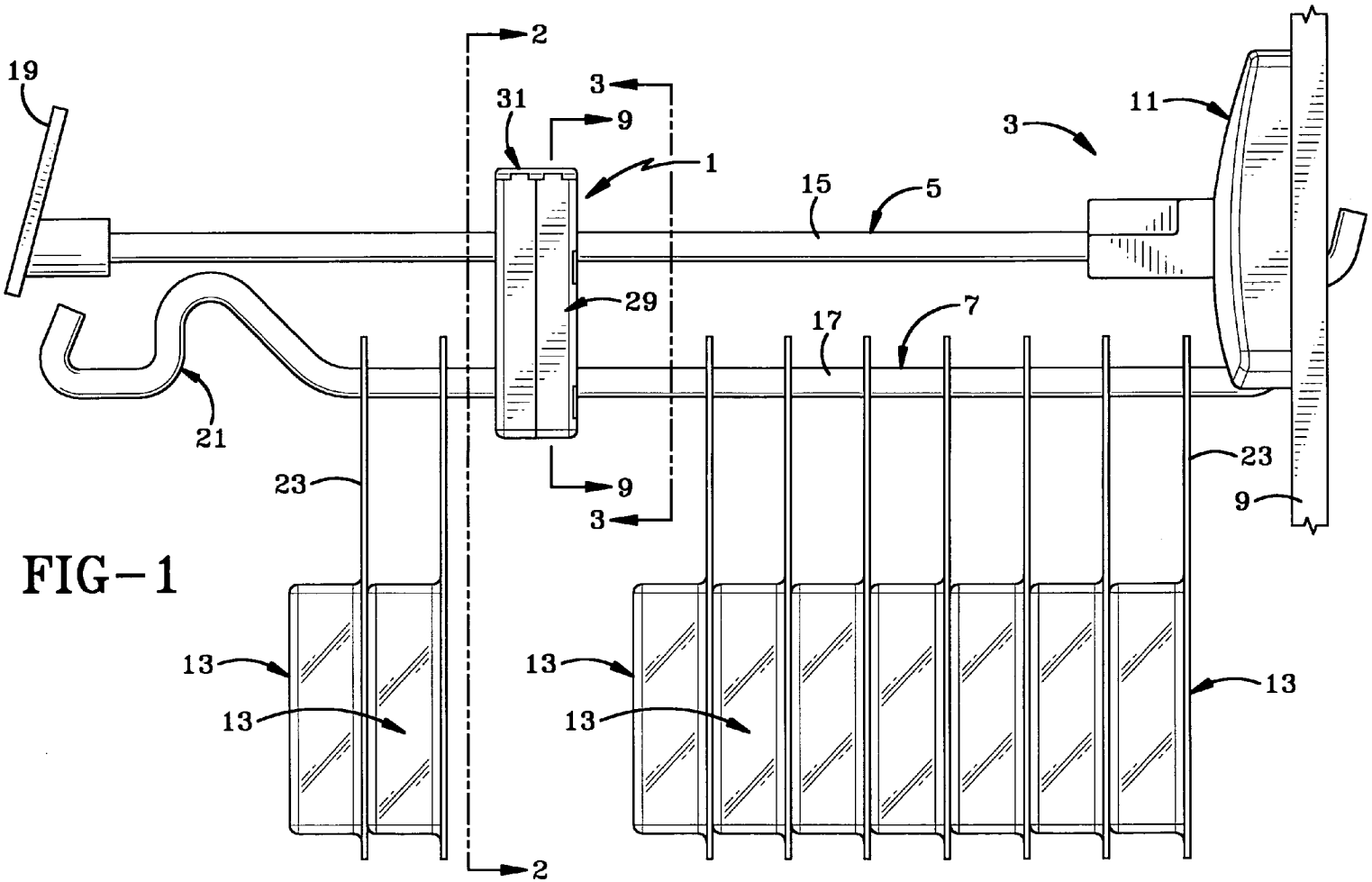
FIG. 1 is a side elevational view of a first embodiment of the lock mechanism mounted on a pair of display rods extending outwardly from a supporting structure.
Figure 11:
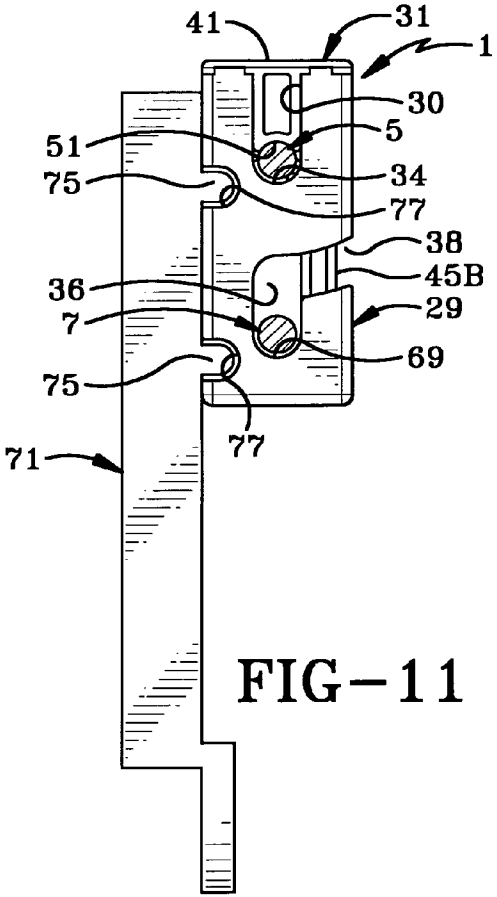
FIG. 11 is a sectional view taken on line 11-11, FIG. 10.
Figure 3:
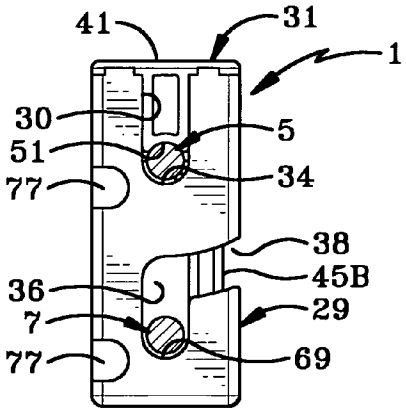
FIG. 3 is a sectional view taken on line 3-3, FIG. 1 showing the lock mechanism in a locked position.
Figure 5:
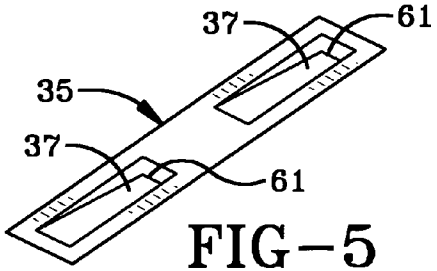
FIG. 5 is a perspective view of the magnetically attractable strip of the locking mechanism.
Figure 2:
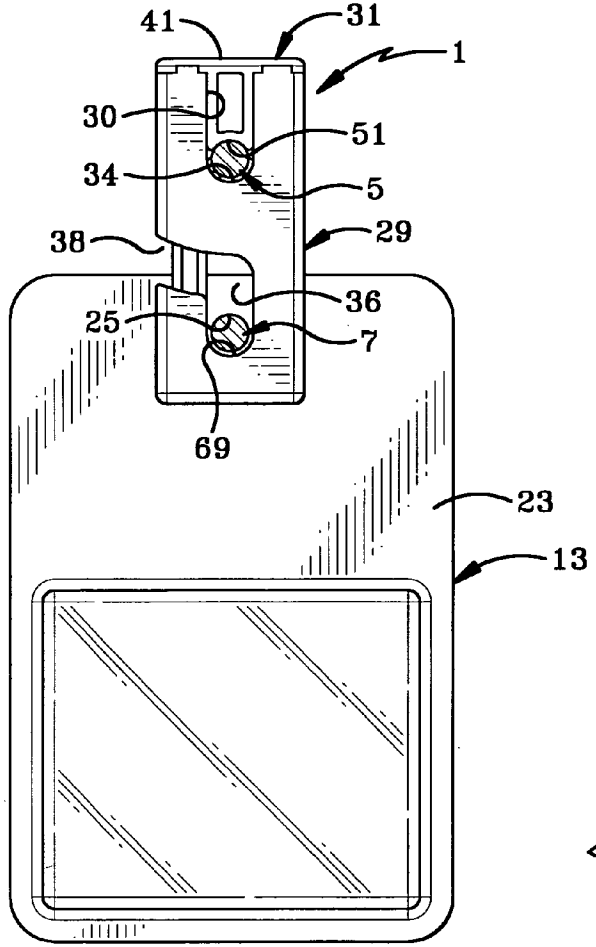
FIG. 2 is a sectional view taken on line 2-2, FIG. 1.

The display rod lock mechanism of the present invention is indicated generally at 1, and is shown in FIG. 1 mounted on a merchandise display assembly 3. Assembly 3 includes a pair of spaced parallel rods 5 and 7 which extend outwardly in a cantilevered-like fashion from a support surface 9 and is shown locked thereto by a base locking mechanism 11. Mechanism 11 preferably is a type of security device which when attached to support surface 9 prevents removal of the pair of rods therefrom, such as shown in U.S. Pat. No. 7,007,810. This prevents a shoplifter from completely removing display assembly 3, including all of the various items of merchandise supported thereon. Rods 5 and 7 preferably are formed of rigid round metal members, each having a generally straight elongated linear section 15 and 17, respectively. Upper rod 5 preferably is linear throughout and has a display face 19 mounted on the distal end thereof for supporting information pertaining to merchandise 13 supported on lower rod 7. Distal end 21 of lower rod 7 preferably is formed with a plurality of curves and bends to prevent sweeping of a plurality of unsecured merchandise 13 from the rod.

The items of merchandise 13 can be blister packs or other types of various package in which certain merchandise is stored. The packages preferably are suspended from rod 7 by a flat card-like section 23 having a hole 25 formed therein through which rod 7 extends. The particular configuration of merchandise 13 can vary considerably, but usually will have some type of slotted or rounded opening formed in the upper end thereof through which rod 7 extends, which will enable the merchandise to be slid in the direction of Arrow A (FIG. 16) for removal from the free distal end 21 thereof.

Figure 8:
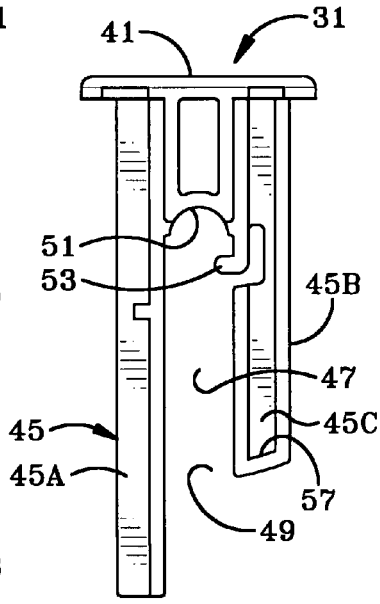
FIG. 8 is a side elevational view of FIG. 7.
Figure 9:
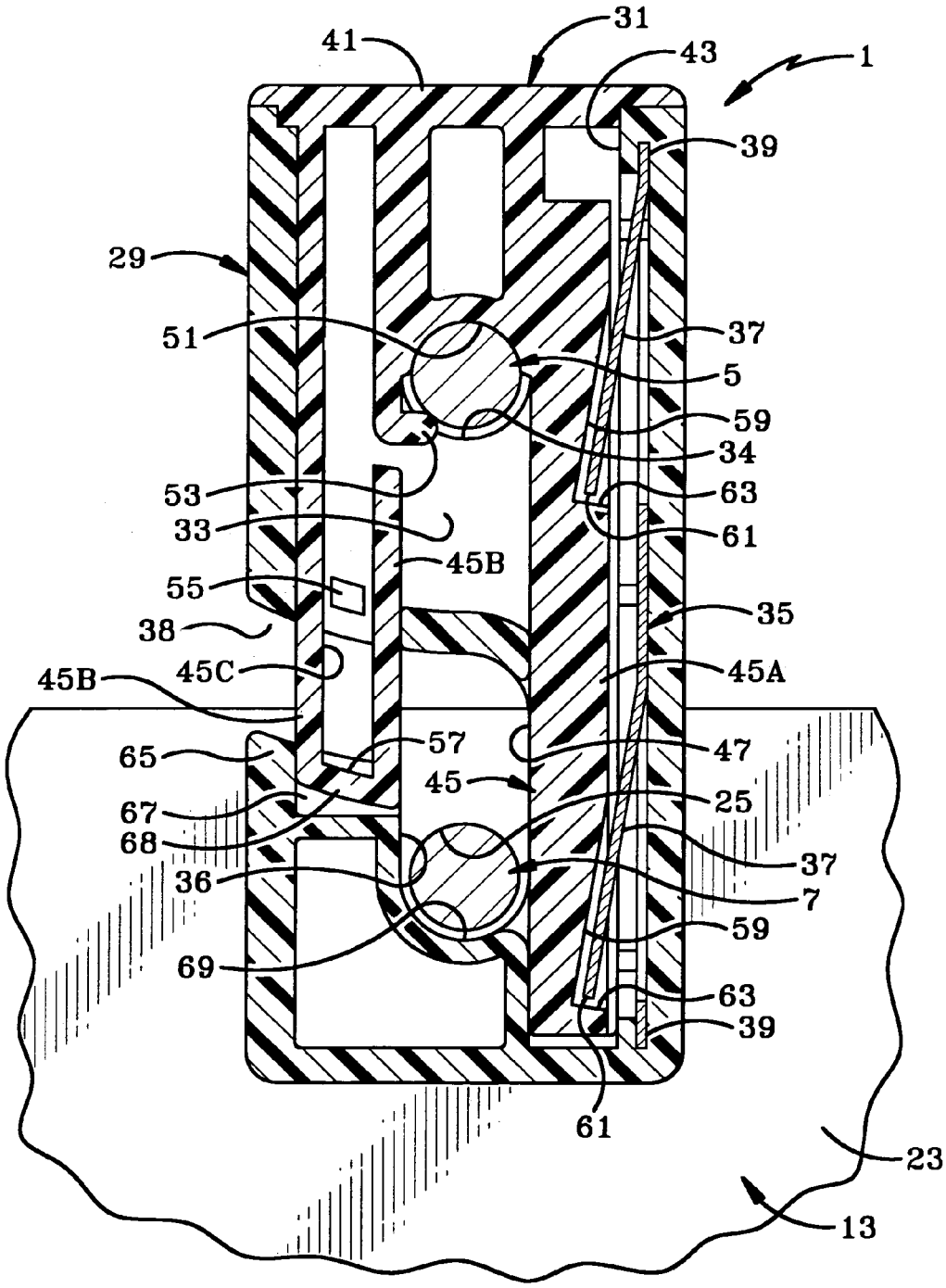
FIG. 9 is an enlarged sectional view taken on line 9-9, FIG. 1 showing the lock mechanism in lock position on the pair of display rods.
Figure 10:
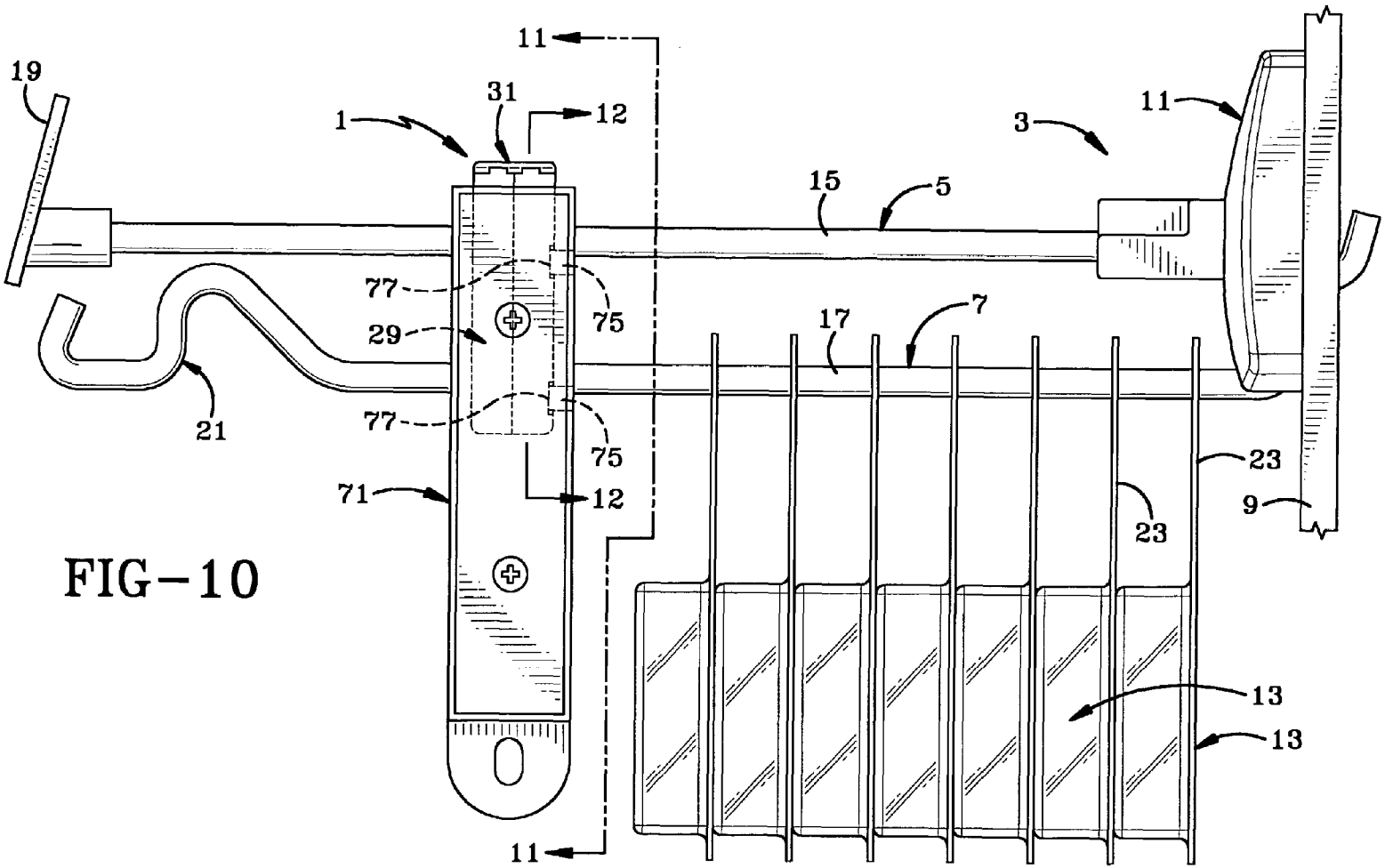
FIG. 10 is a side elevational view similar to FIG. 1 showing the key placed on the locking mechanism.
Figure 12:
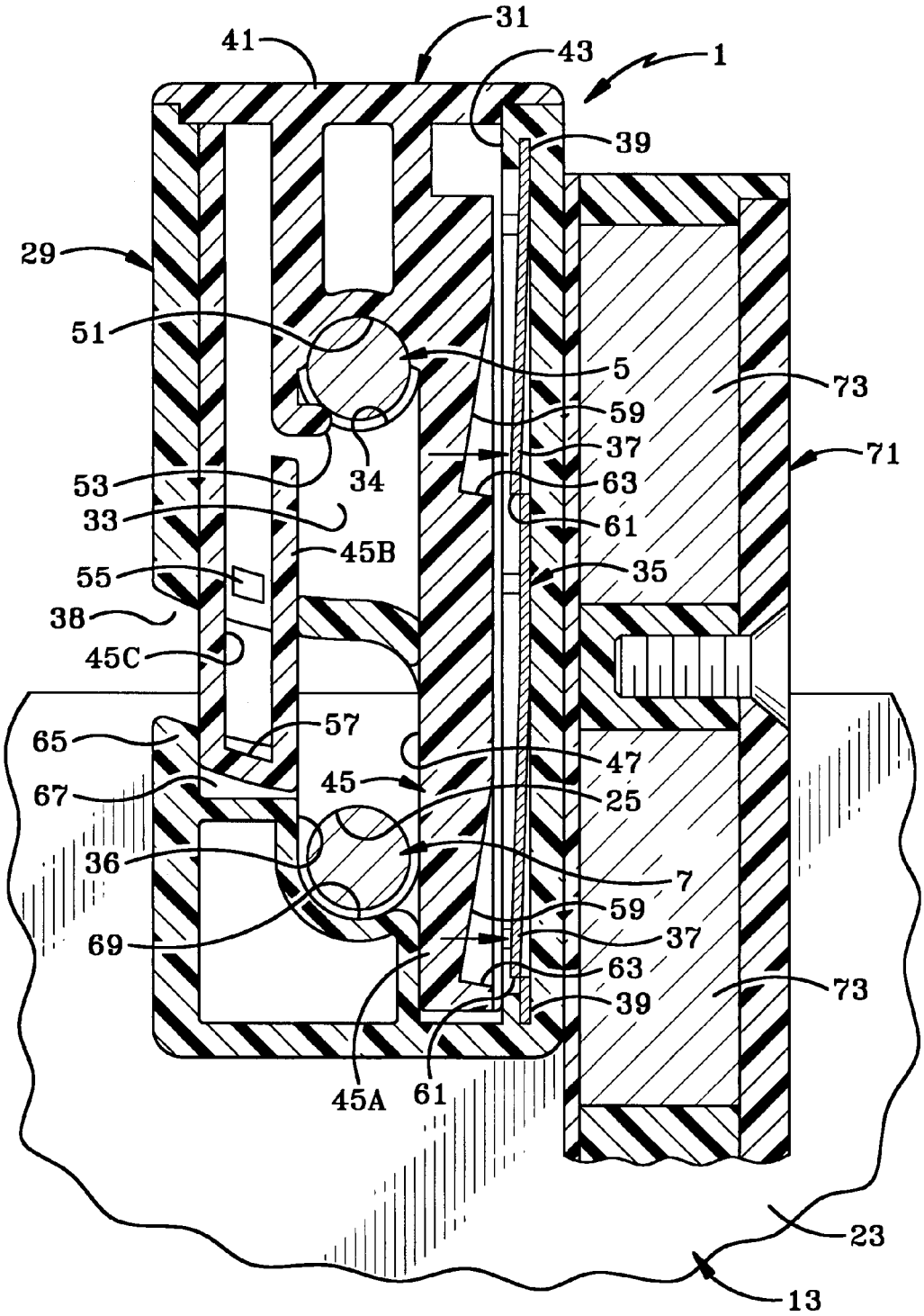
FIG. 12 is an enlarged sectional view taken on line 12-12, FIG. 10, showing the locking tines moved from locked to unlocked position.
Figure 14:
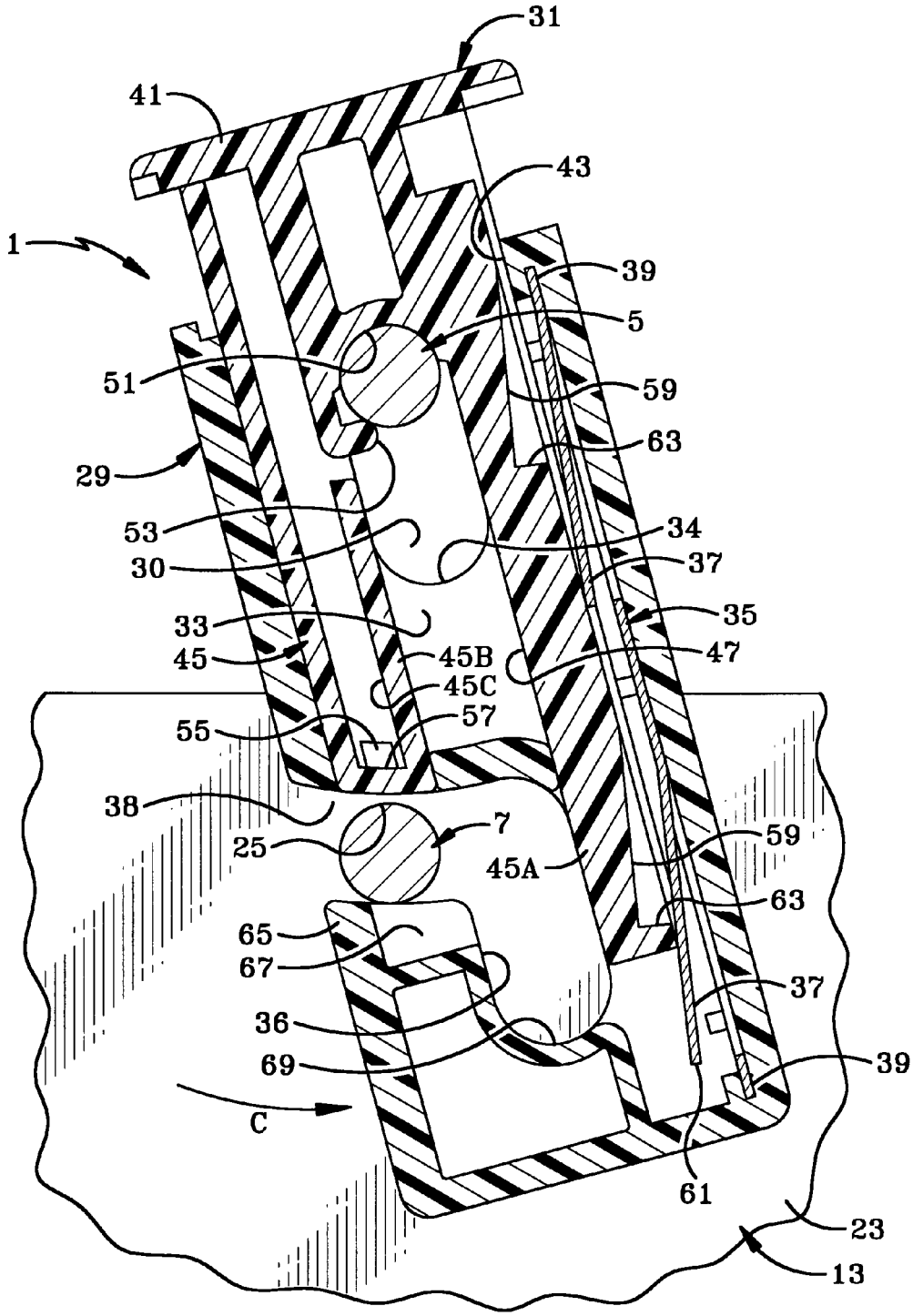
FIG. 14 is a sectional view similar to FIG. 13 showing the locking mechanism being pivoted to a disengaged position from the lower rod.
Figure 15:
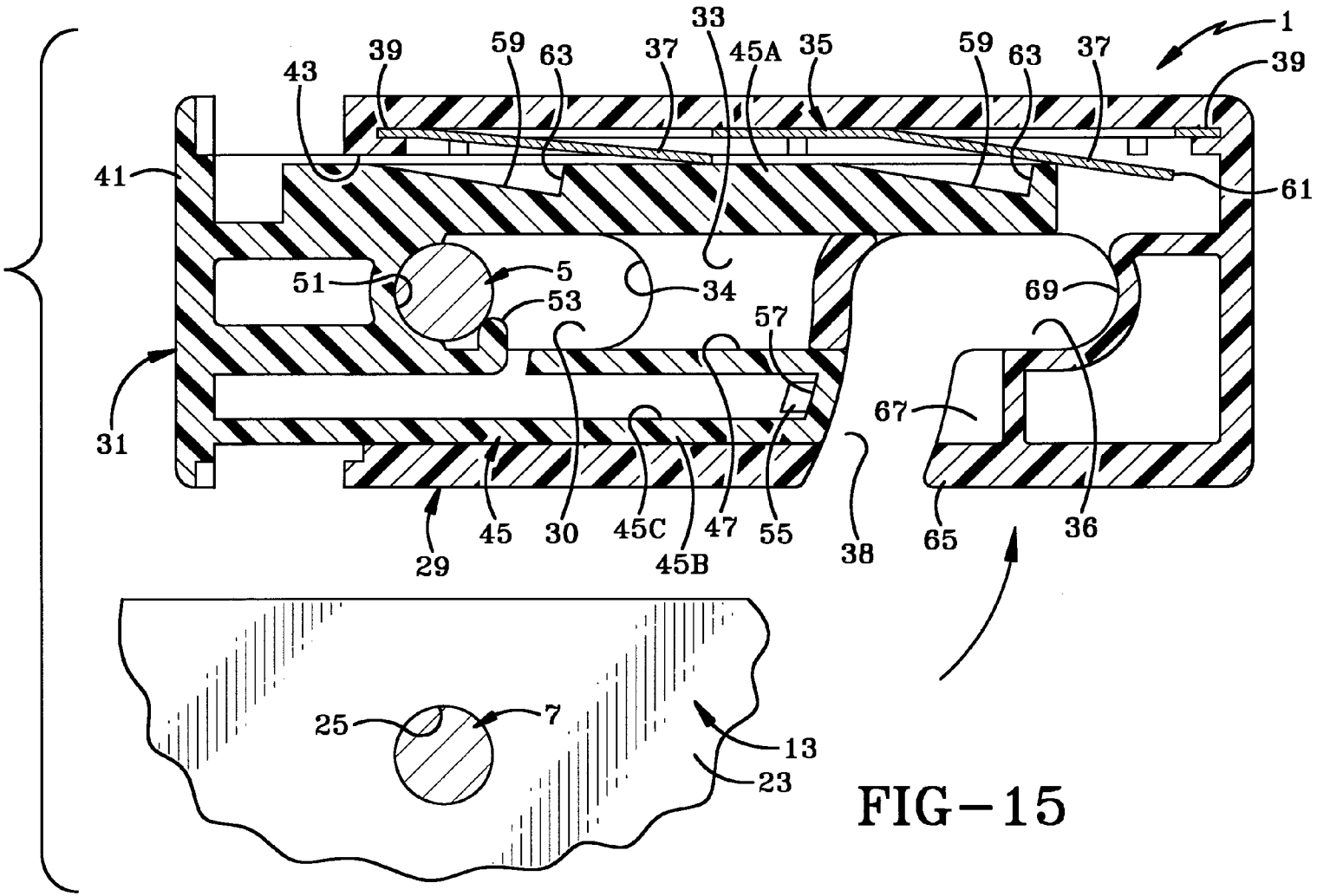
FIG. 15 is a view similar to FIG. 14 showing the locking mechanism moved completely out of engagement with the lower rod.

A first embodiment of lock mechanism 1 is shown particularly in FIGS. 2-16 and includes two members, a lower housing 29 and a locking bayonet 31. Member 29 and 31 are slidably joined together and are movable between a closed locked position as shown in FIG. 9, to a closed unlocked position as shown in FIG. 12, and then to an open unlocked position as shown in FIG. 15 where the lock mechanism can be completely disengaged from lower rod 7. Members 29 and 31 preferably are formed of a rigid plastic enabling them to be produced relatively inexpensively and in various colors making them aesthetically pleasing when mounted on display mechanism 3 as shown in FIG. 1.

Housing 29 has a generally elongated rectangular configuration as shown particularly in FIGS. 2-6, and is formed by two half members 29A and 29B which when secured together by an ultrasonic weld, adhesive, etc, form an internal lock chamber 33. Each housing half member is formed with an elongated upper slot 30A having a top opening 32A and a bottom concave end 34A. A lower elongated slot 36A is formed in each housing member and the top portions thereof communicate with side opening slots 38A. The half housing member slots align with each other when in an assembled position to form slots 30 and 36 and a side opening slot 38, which slots extend completely through housing 29 for receiving and trapping upper rod 5 in slot 30 and lower rod 7 in slot 36.

Figure 4:
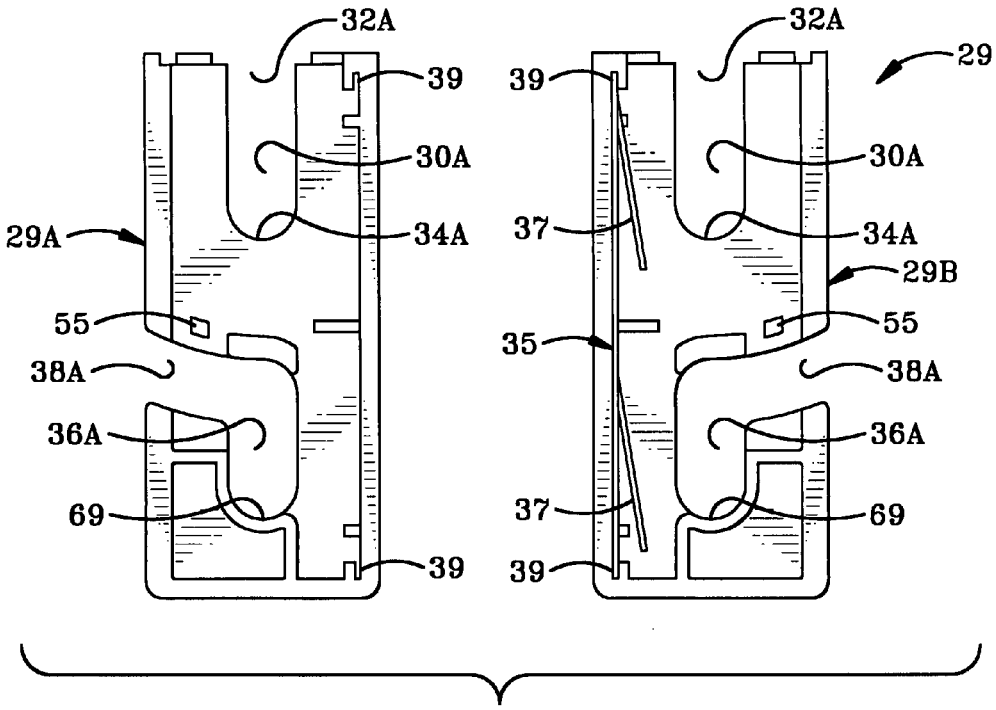
FIG. 4 is a exploded elevational view of the lower housing member of the lock mechanism.
Figure 6:
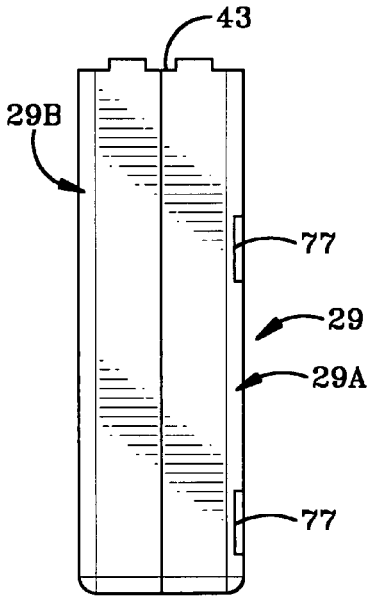
FIG. 6 is a side elevational view of the housing member of FIG. 4 in assembled position.
Figure 7:
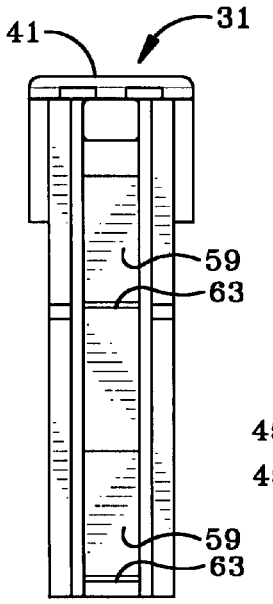
FIG. 7 is an end elevational view of the bayonet component of the locking mechanism.

A metal locking strip 35 (FIG. 5) is formed of spring steel and has two locking tines 37 extending outwardly from the main strip body. Tines 37 are biased in an outwardly extending direction when mounted within housing member 29B as shown in FIG. 4, preferably by sliding the two distal ends of strip 35 in spaced small recesses 39 formed in housing halves 29A and 29B.

Locking bayonet 31 (FIGS. 7 and 8) has a top upper closure member 41 which encloses an open top 43 of housing 29 and lock chamber 33 (FIG. 9) and includes an elongated body 45 having an elongated opening slot 47 formed therein, which has an open bottom 49 and a generally semi-circular concave surface upper end 51. A resilient finger like tab 53 is formed near the upper end of slot 47 adjacent concave surface 51, which enables bayonet 31 to be snap fitted onto upper rod 5 as shown in FIG. 9. This snap fit engagement assists in retaining bayonet 31 on rod 5 and provides a pivotal type mounting of the bayonet on rod 5. Body 45 is formed by a pair of elongated legs 45A and 45B with leg 45A being longer than leg 45B as shown in FIG. 8. A pair of ramped projections 55 are formed on housing members 29A and 29B, which when the housing is in assembled position provides for a one way snap fit engagement with bayonet 31 when the bayonet is slidably inserted into lock chamber 33.

The manner of operation of lock mechanism 1 is best shown in FIGS. 9 through 16 and is described below. Lock mechanism 1 is mounted on rods 5 and 7 preferably by initially snap fitting bayonet 31 onto top rod 5 by use of resilient finger tab 53. Housing 29 is then slidably engaged with bayonet 31 by sliding bayonet 31 into lock chamber 33 of housing 29. Upon slidably inserting the bayonet in housing 29 the lower end of body leg 45B moves beyond the pair of one way ramp projections 55 which snap fit into elongated channels 45C formed in each side of leg 45B which provides sliding movement of bayonet 31 within housing 29 while retaining bayonet 31 and housing 29 in an assembled position preventing the removal of the lock mechanism from upper rod 5. Raised distal end surfaces 57 of channels 45C trap ramp projections 55 within the pair of slide channels and provide a pair of stop surfaces for limiting the sliding movement of bayonet 31 and housing 29. Complete insertion of bayonet 31 within locking chamber 33 will close open top 43 of housing 29 as shown in FIG. 9, in which position lock tines 37 will snap into a pair of elongated sloped recesses 59 formed in the outer end surface of bayonet leg 45A. The distal ends 61 of locking tines 37 abut against shoulders 63 formed at the ends of recesses 59 to prevent movement of bayonet 31 and housing 29 in an unlocking direction until the tines are moved to an unlocked position as shown in FIG. 12.

Figure 16:
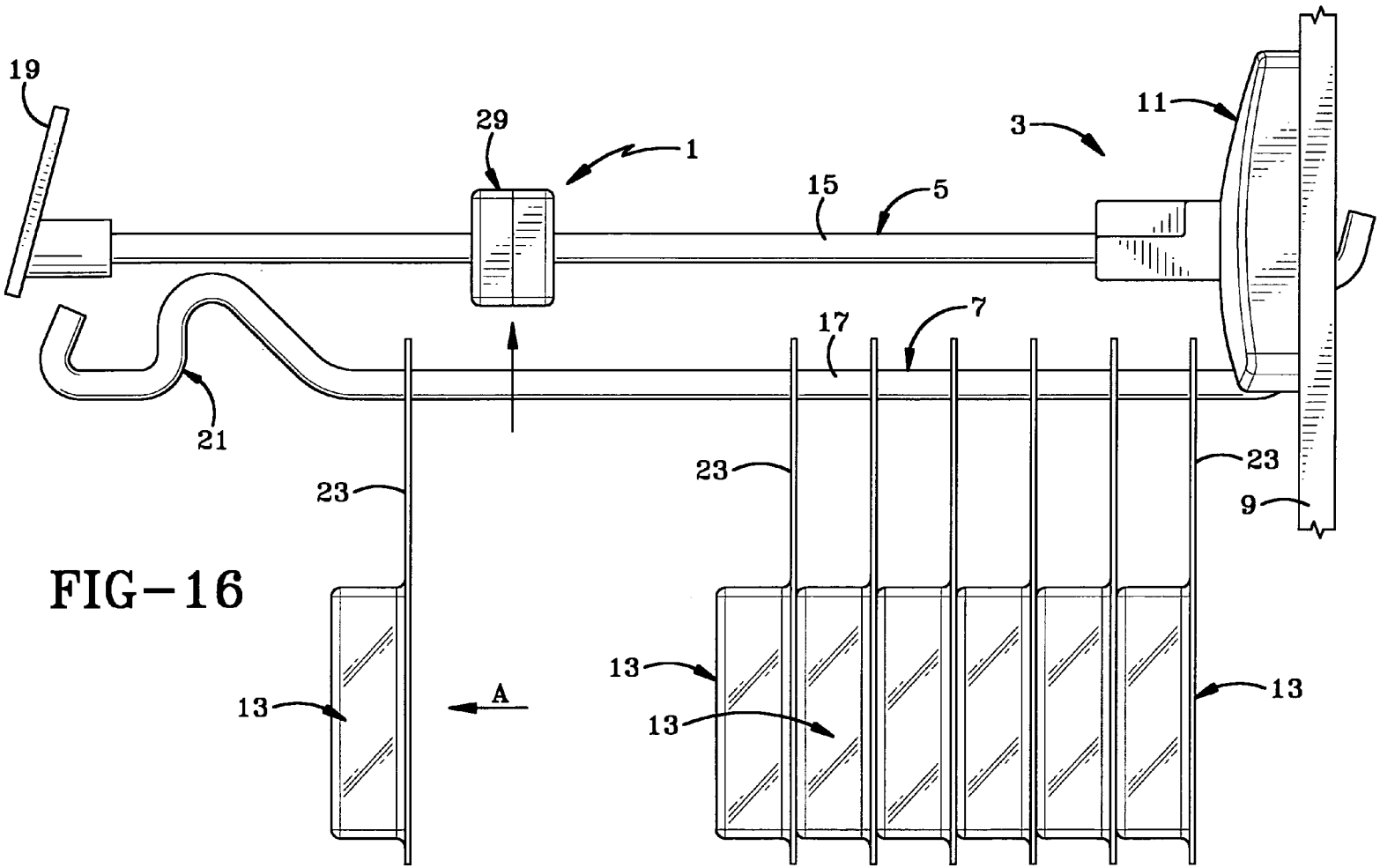
FIG. 16 is a side elevational view similar to FIGS. 1 and 10 showing the lock mechanism in a complete disengaged position from the lower rod enabling the items of merchandise to be moved freely from the rod.
Figure 17:
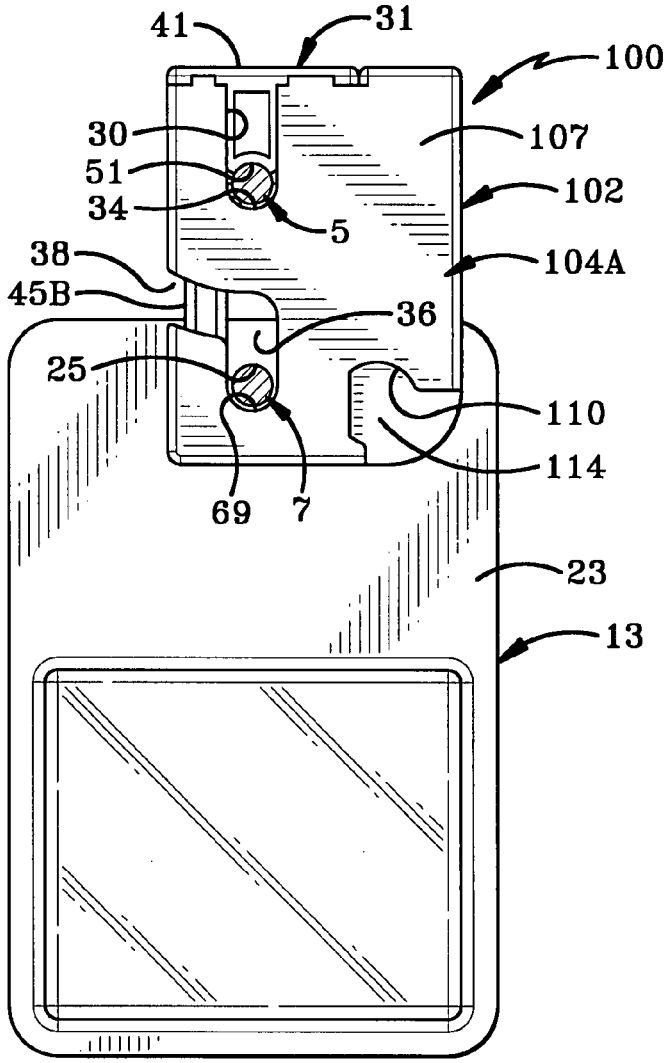
FIG. 17 is a sectional view similar to FIG. 2 of a second embodiment of the lock mechanism of the present invention mounted on a pair of display rods.
Figure 18:
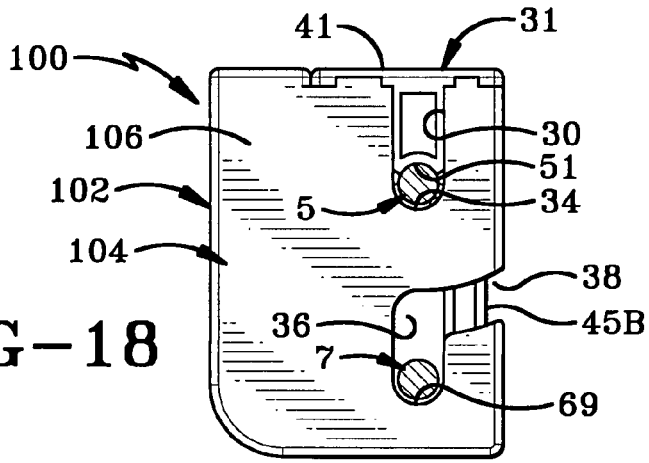
FIG. 18 is a rear elevational view of the modified lock mechanism of FIG. 17 shown mounted in a closed locked position on the pair of display rods shown in cross section.

When in the closed locked position of FIG. 9, lock mechanism 1 is locked on rods 5 and 7 preventing any items of merchandise located between lock mechanism 1 and support 9 as shown in FIG. 9, from being removed from the lower rod 7. Preferably one or more of the items of merchandise will be located forward of lock mechanism 1 enabling them to be individually removed from distal end 21 for subsequent purchase by a customer. A merchant can easily move additional items of merchandise to the unsecured position in front of the lock mechanism by unlocking the lock mechanism and moving it to an open unlocked position as shown in FIG. 16 as described further below, enabling the previously secured items of merchandise to be moved forward of the lock mechanism for subsequent purchase. When in the locked position of FIG. 9, housing 29 is prevented from pivoting to an open position as shown in FIG. 14 through side opening slots 38 by trapping distal end 68 of leg member 45B behind a ledge 65 of a recess 67 formed in the lower portion of housing 29, above the semi-circular end surface 69 of slots 36.

Figure 13:
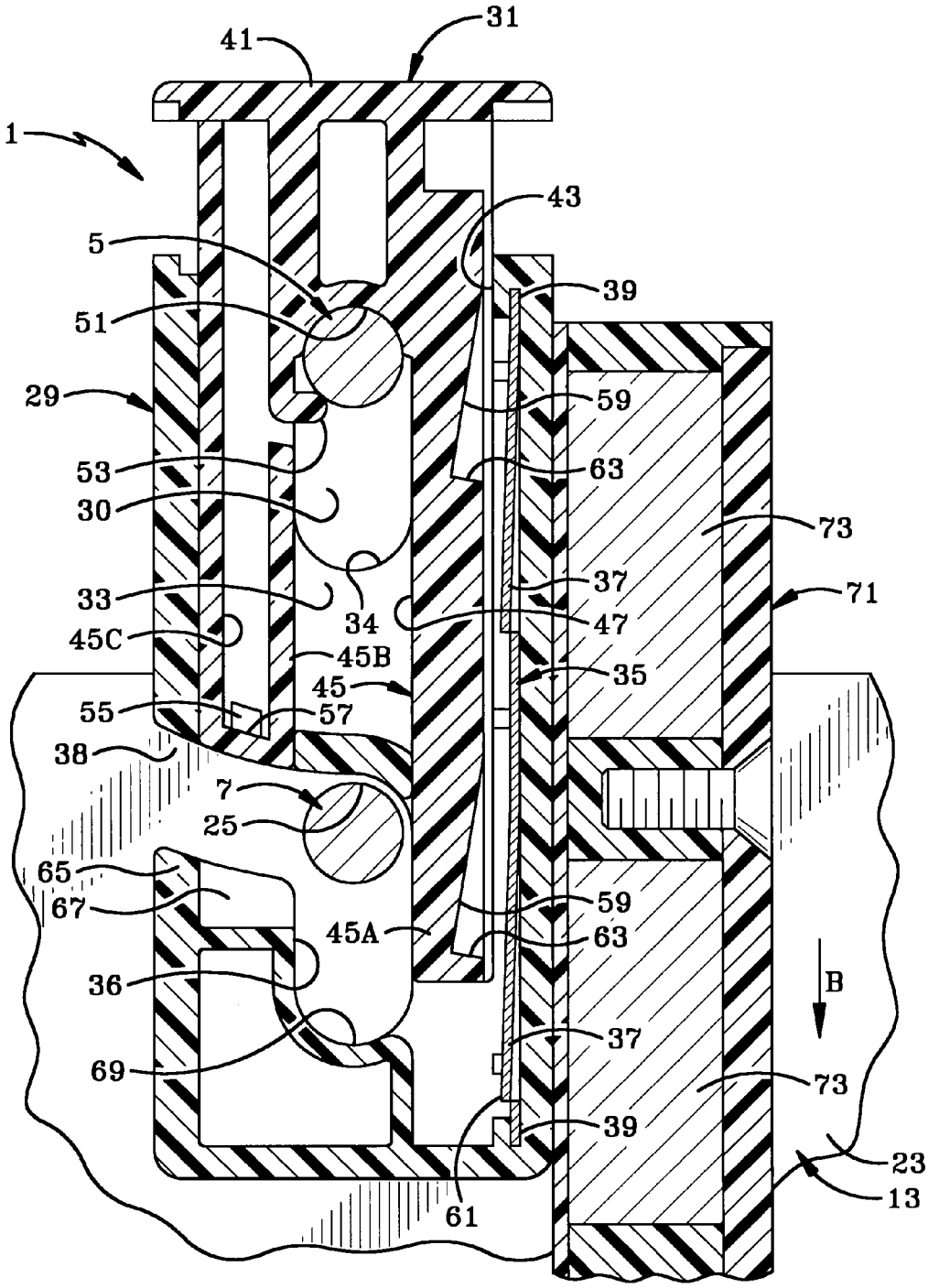
FIG. 13 is a sectional view similar to FIG. 12 showing the housing member being moved downwardly to an open unlocked position.

To unlock mechanism 1, a magnetic key 71, which preferably contains two magnets 73, is placed in a predetermined position against the side of housing 29 by aligning two positioning tabs 75 on the key within slots 77 formed in the housing. This ensures that magnets 73 each align individually with one of the tines 37 for moving the tines from the locked position of FIG. 9 to the unlocked position as shown in FIG. 12. The merchant then can move key 71 in a downward direction as shown by arrow B in FIG. 13, which will move housing 29 downwardly with respect to locking bayonet 31 which remains in its supported trapped position on upper rod 5, until ramp projections 55 engage lower edges 57 of recesses 450 as shown in FIG. 13. This exposes side opening slot 38 to lower rod 7 enabling the lock mechanism to be pivoted as shown by arrow C (FIG. 14), whereupon lower rod 7 moves through side opening slot 38 completely free of lower rod (as shown in FIGS. 15 and 16. This enables the previously protected items of merchandise 13 to be moved forwardly along rod 7 for complete removal from the rod or to store one or more of the items in front of lock mechanism 1 prior to the lock mechanism being returned to its locked position as shown in FIG. 1. To relock mechanism 1 on rods 5 and 7, the mechanism is merely pivoted downwardly from the position of FIG. 15 to that of FIGS. 14 and 13, afterwhich housing 29 is moved upwardly in the opposite direction to arrow B of FIG. 13 to that of FIG. 9, wherein locking tines 37 automatically snap into locking engagement in recesses 59 behind locking projections 63.

Thus once installed on the pair of rods 5 and 7, lock mechanism 1 remains permanently attached to upper rod 5 and is removably attached and locked to lower rod 7 enabling a plurality of items of merchandise 13 to be secured in a locked position between support surface 9 and lock mechanism 1, with one or more of the items of merchandise 13 being in an unsecured position in front of lock mechanism 1 enabling them to be individually dispensed through the circuitous distal end 21 of rod 7 for purchase by a customer.

Another feature of the invention is that the pair of rods is securely locked to support surface 9 by base locking mechanism 11 with the upper rod supporting a display face 19 to provide information regarding the items of merchandise stored and displayed on lower rod 7. Also anti-sweep distal end 21 of lower rod 7 assists in preventing theft of the forward unsecured items of merchandise.

A modified form of the lock mechanism of the present invention is indicated generally at 100, and is shown in FIGS. 17-27. Lock mechanism 100 is similar in many respects to lock mechanism 1 discussed above, and thus the same numerals are used throughout FIGS. 17-27 when referring to common parts. Lock mechanism 100 includes a housing 102 formed by two half members 104 and 104A (FIG. 19) which are secured together by an ultrasonic weld, adhesive, etc. to form an internal lock chamber 105. Lock member 104A forms the front portion of housing 102 and member 104 forms the rear portion of the housing. Each housing member is formed with upper slot 30A having the top opening 32A with the bottom concave end 34A. The lower elongated slot 36A is formed in each housing member and the top portions thereof communicate with side openings slots 38A as discussed above with respect to lock mechanism 1. Again, the half housing member slots align with each other when in an assembled position to form slots 30 and 36 and side opening slot 38, which slots extend completely through housing 102 from back surface 106 to front surface 107 for receiving and trapping upper rod 5 in slot 30 and lower rod 7 in slot 36.

Metal locking strip 35 is mounted within housing member 104A (FIG. 19) and locking bayonet 31 is received through open top 32 in the same manner as discussed above with respect to lock mechanism 1. The main difference between lock housing 102 of lock mechanism 100 with respect to lock housing 29 of lock mechanism 1 is that it is larger and is formed with a chamber 108 for receiving an electronic article surveillance (EAS) tag 109 therein. EAS tag 109 will be an acousto-magnetic (AM), electromagnetic (EM) or radio-frequency (RF) device depending upon the particular signaling alarm system used by a security gate at the exit of a secured area.

Figure 19:
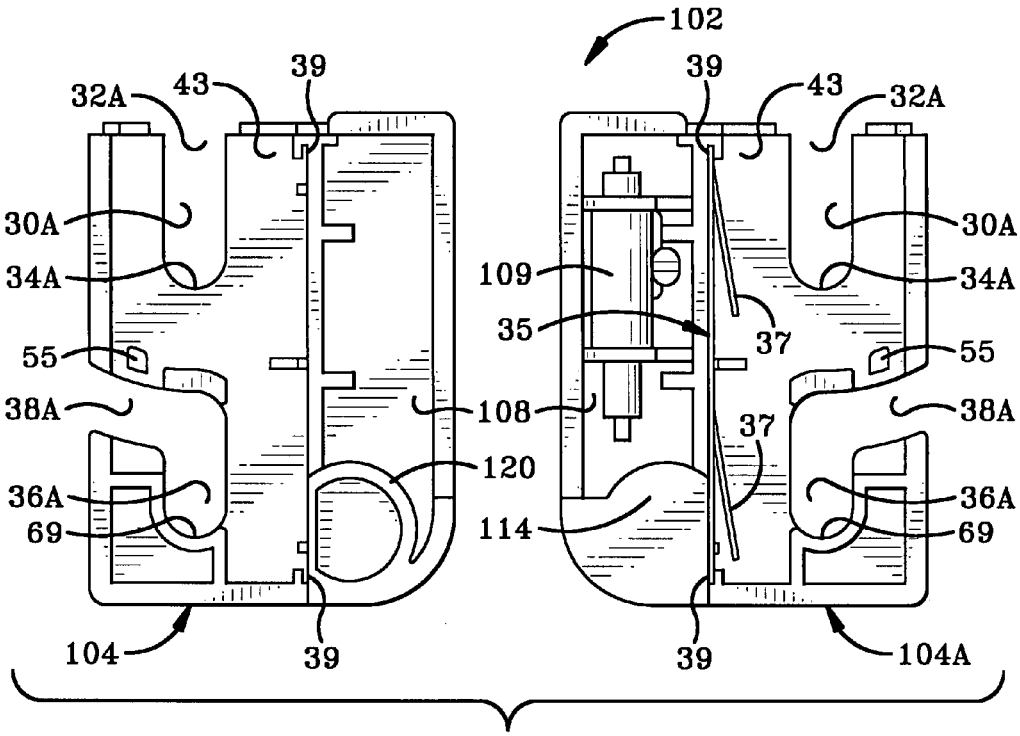
FIG. 19 is an exploded elevational view of the lower housing member of the modified lock mechanism.
Figure 20:
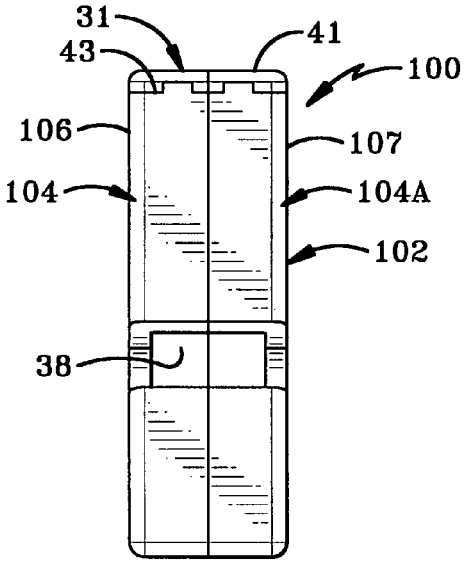
FIG. 20 is a right side elevational view of the lower housing member as shown in FIG. 18 in assembled position.
Figure 21:
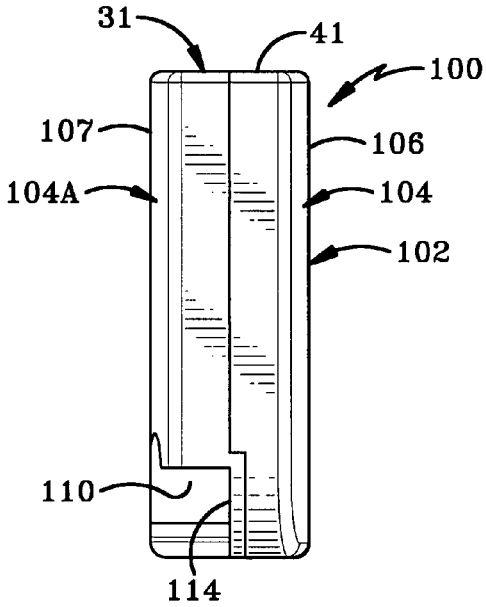
FIG. 21 is a right side elevational view of the lower housing member as shown in FIG. 17.
Figure 24:
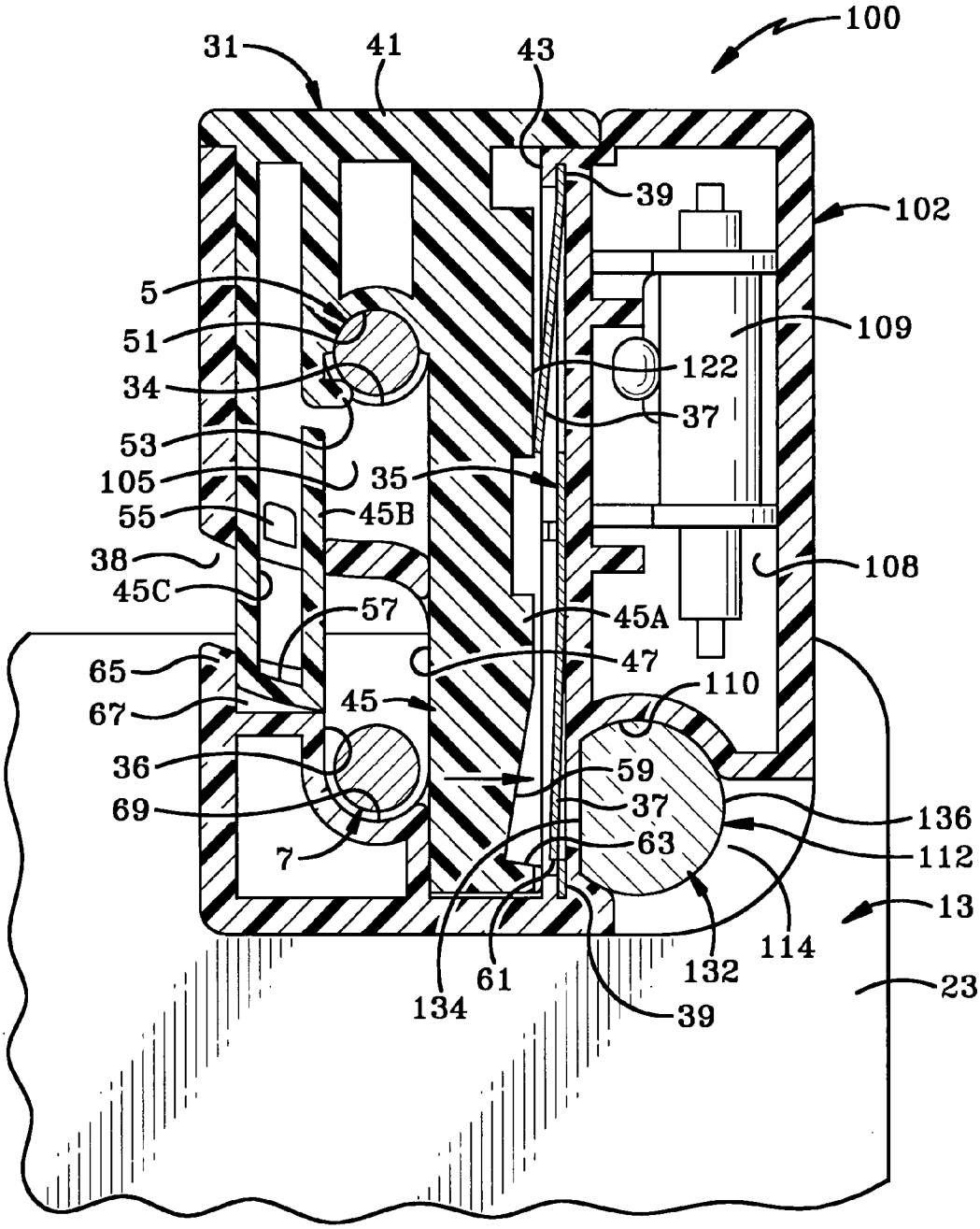
FIG. 24 is an enlarged sectional view taken on line 24-24, FIG. 23 showing the lock mechanism in a closed unlocked position.

The lower portion of housing half member 104A is formed with a specifically shaped recess 110 for receiving a magnetic key 112 therein as shown in FIG. 24. Recess 110 terminates in a rear wall 114 formed in the lower portion of housing half member 104 (FIG. 19). Recess 110 extends at generally right angles to the front surface 107 of lock housing 102 as shown particularly in FIG. 21. Recess 110 is complementary sized and shaped to accept only the specially shaped key 112 therein as is described further below. Housing member 104 has a shaped reinforcing rib 120 (FIG. 19) located behind rear wall 114. It is contemplated that recess 110 will be designed for a particular industry or store specific use. As such, each industry or store will have a security system that includes a specifically shaped recess and can be unlocked only with a customized key 112 that has a complementary-shaped cross sectional profile to that of recess 110.

Figure 22:
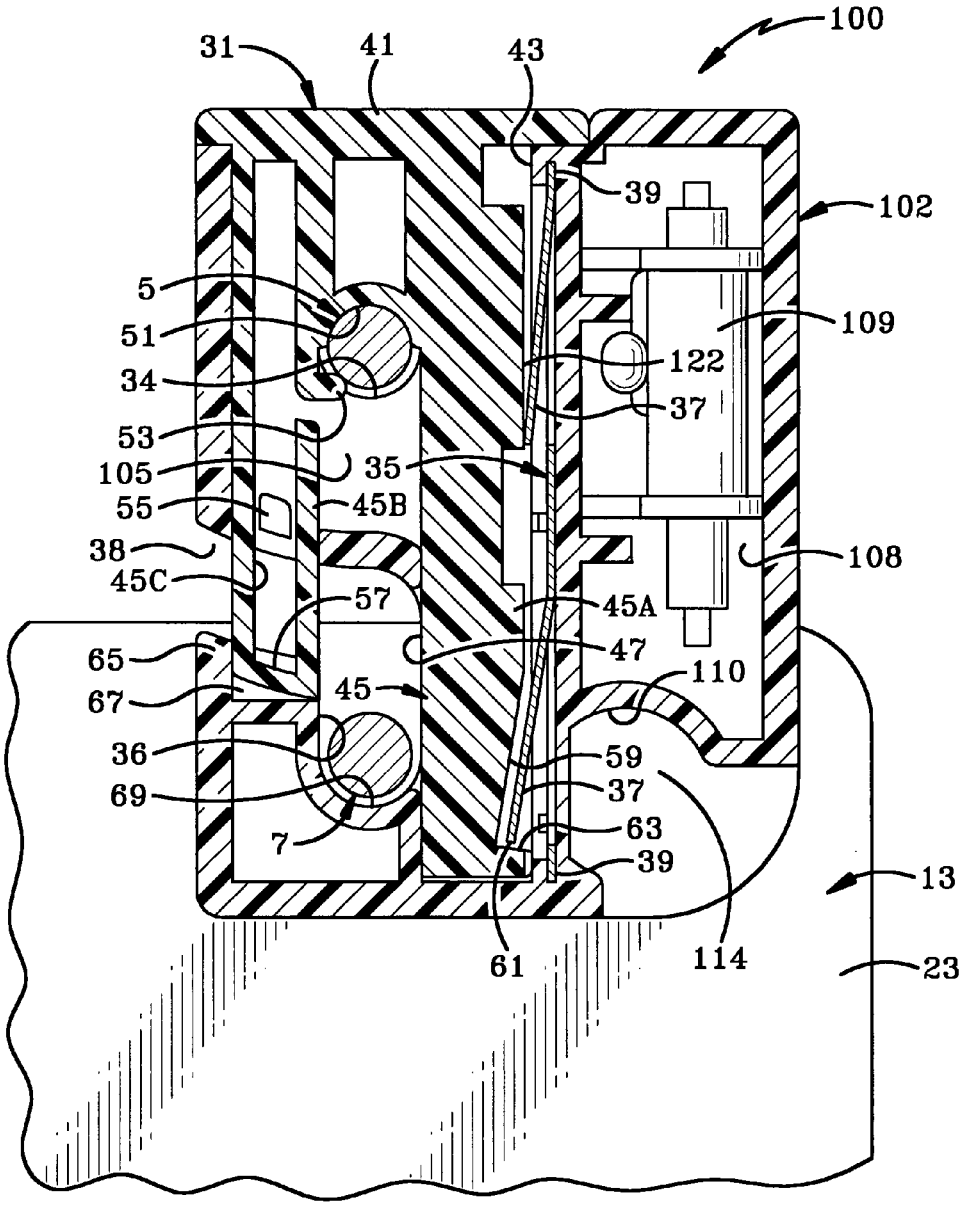
FIG. 22 is an enlarged sectional view similar to FIG. 9 showing the modified lock mechanism in a closed locked position on a pair of display rods.

In the preferred embodiment, recess 110 is essentially D-shaped (FIG. 22) and can be accessed by a complementary shaped D-shaped key 112. However, it is readily understood that the key recess and the associated key can have other shapes such as trapezoidal, hexagonal, triangular etc. without affecting the concept of the present invention. If the recess is otherwise shaped, then the key would be manufactured with a complementary shape. This arrangement substantially reduces the possibility of a would-be thief unlocking lock mechanism 100 with a commonly available magnetic as the magnet would have to a specific cross sectional shape to fit into the recess and attract locking tine 37 to an unlocked position as shown in FIG. 24. As shown in FIG. 22, the housing is locked onto rods 5 and 7 in a similar manner as shown in FIG. 9, with the exception that only the lower locking tine 37 is located in sloped recess 59 and with its distal end 61 being adjacent shoulder 63. Upper locking tine 37 merely rests against a flat wall portion 122 of locking bayonet 31.

Figure 23:
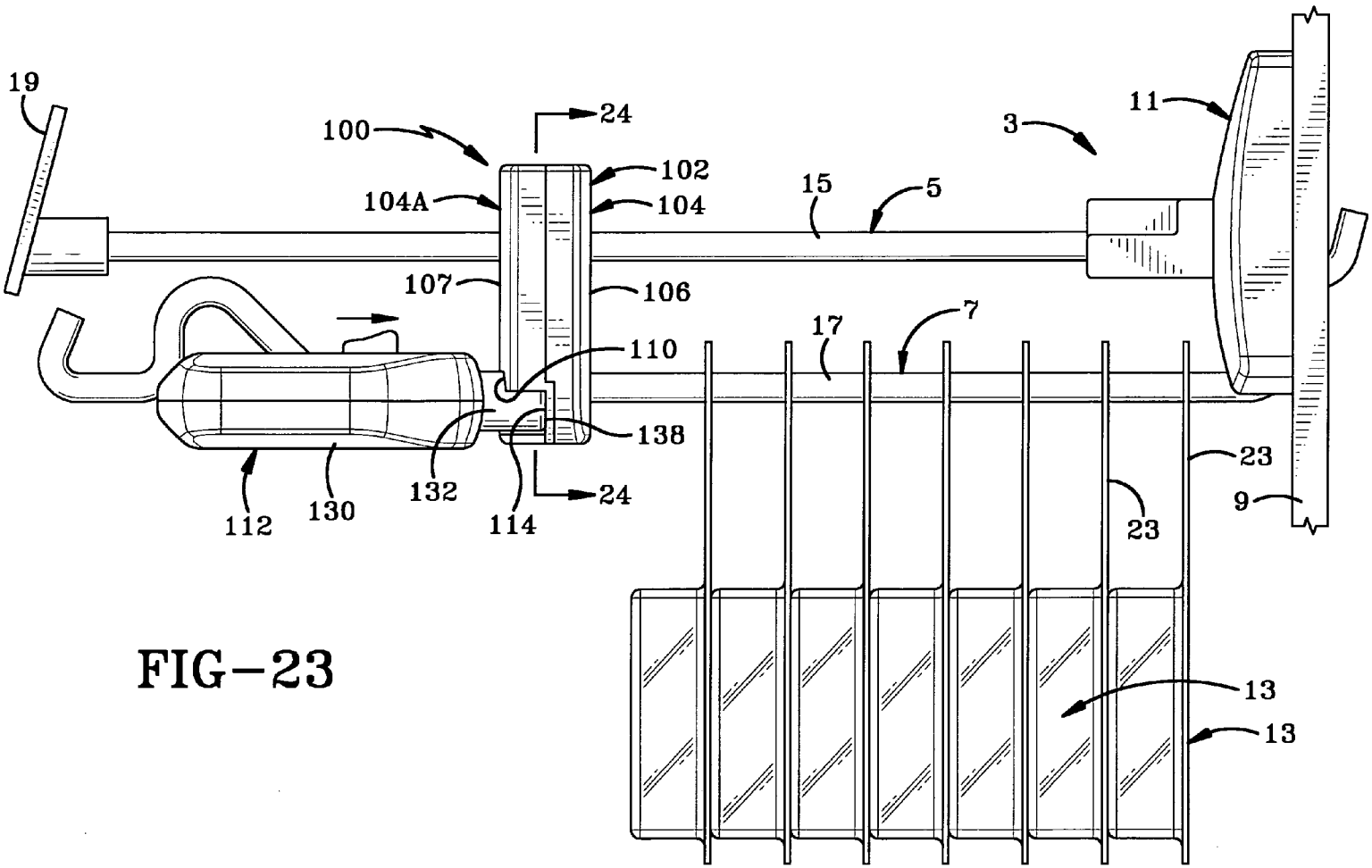
FIG. 23 is a side elevational view showing an unlocking key placed on the modified lock mechanism.
Figure 27:
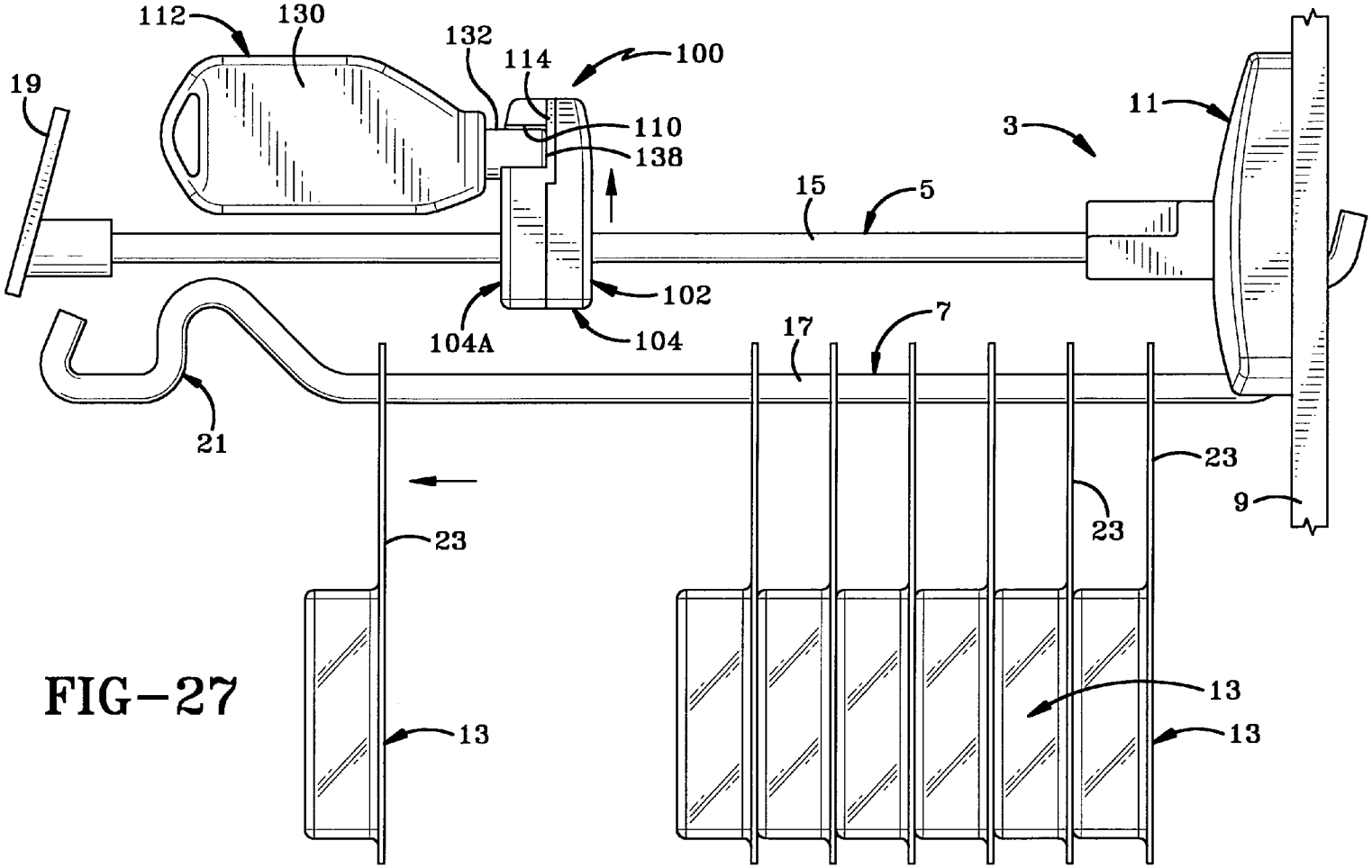
FIG. 27 is a side elevational view showing the lock mechanism in a complete disengaged position from the lower rod enabling items of merchandise to be moved freely from the rod.

To unlock lock mechanism 100, magnetic key 112 is placed into key recess 110 as shown in FIGS. 23 and 24 which will attract the lower locking tine 37 to the unlocked position as shown in FIG. 24, enabling housing 102 to be moved downwardly in the direction of Arrow D (FIG. 25) wherein lower rod 7 aligns with side opening slot 38 enabling lock mechanism 100 to be pivoted on upper rod 5 in the direction of Arrow E (FIG. 26) until it becomes disengaged from the lower rod 7 to the position as shown in FIG. 27 enabling the items of merchandise to be easily removed from rod 7. Lock mechanism 1 is then returned to its locked position as shown in FIG. 22 in the same manner as discussed above with respect to lock mechanism 1.

In accordance with one of the features of the invention, magnetic key 112 is a dipole magnet and can be of the type described in pending patent application Ser. No. 60/879,852, filed Jan. 11, 2007. Magnetic key 112 preferably includes an outer protective housing 130 having the particular D-shaped dipole magnet 132 slidably mounted therein. Dipole magnet 132 preferably has a D-shaped configuration with a flat planar face 134 and an arcuate face 136 with a flat end face 138.

As discussed in the above identified patent application, dipole magnet 132 can be specially manufactured to create a specific pole at planar face 134 and the other pole at the arcuate face 136. This is done so that only the appropriate pole is brought into proximity of the locking mechanism, and in particular lower locking tine 37 when the magnet is inserted into recess 110. If the incorrect pole is brought into the proximity of the locking tine, it would not move to the unlocked position as desired. Thus, dipole magnet 132 is manufactured so that one of the north or south poles of the magnet is created at the planar face and the other pole created at the arcuate face. Furthermore, it is easily seen that upon the magnet being inserted into the key recess 110, it can remain therein and used to easily pivot the lock mechanism from the unlocked position of FIG. 24 to the disengaged position of FIG. 26 without removing the key from the lock mechanism. Furthermore, once the lock mechanism is returned to the closed unlocked position and the magnetic key removed therefrom locking lower locking tine 37 automatically moves from the unlocked position of FIG. 24 to the locked position of FIG. 22. Lock mechanism 100 thus provides additional advantages over lock mechanism 1 in that it is provided with an EAS tag which will actuate an alarm at a security gate if attempted to be moved therethrough in an unauthorized manner and which requires a specially-shaped and type of magnet such a dipole magnet having a cross-sectional D-shaped configuration, reducing the possibility that a thief could use a common bar magnet for unlocking the lock mechanism.

Figure 25:
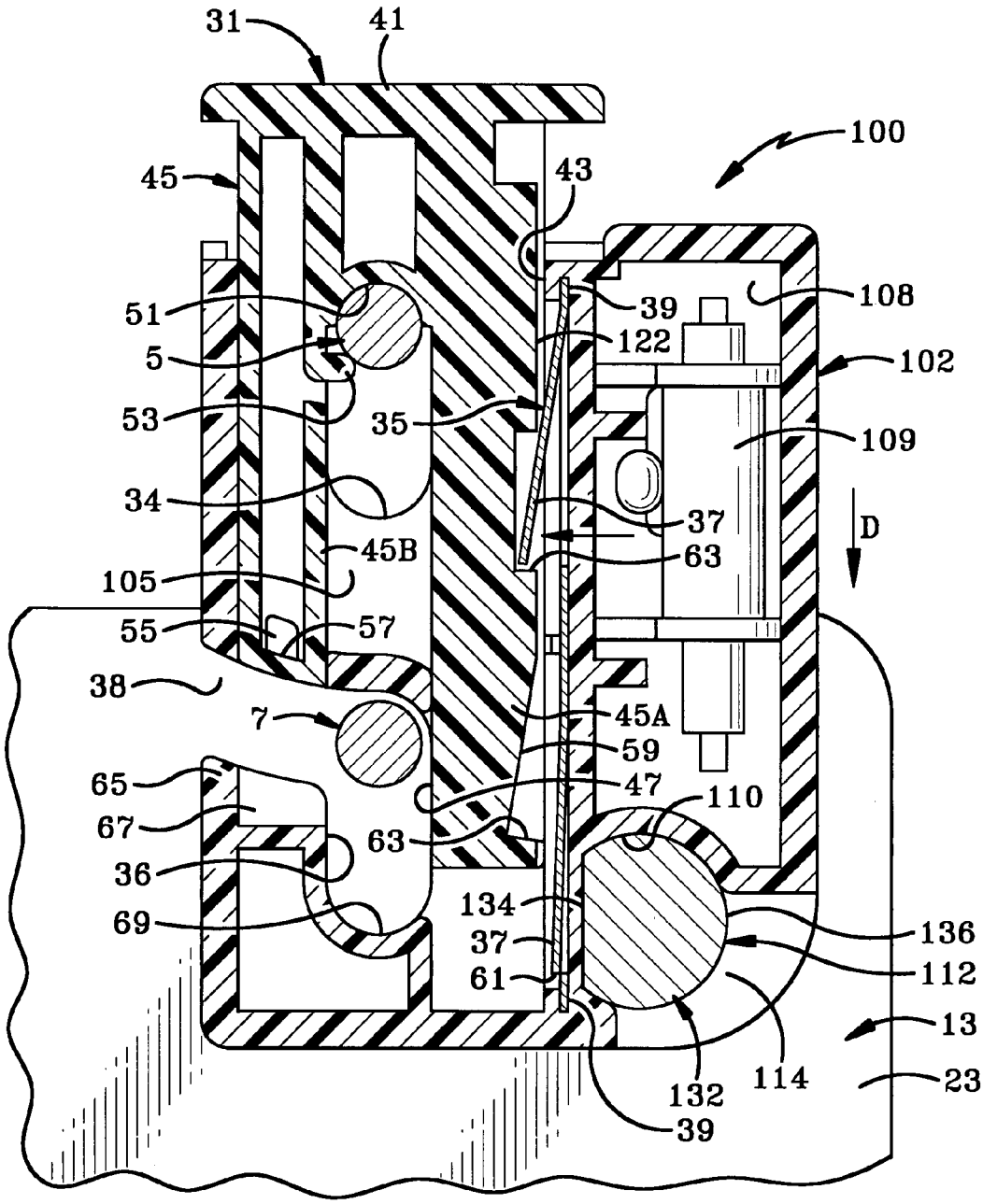
FIG. 25 is a sectional view similar to FIG. 24 showing the housing member being moved downwardly to an open unlocked position.
Figure 26:
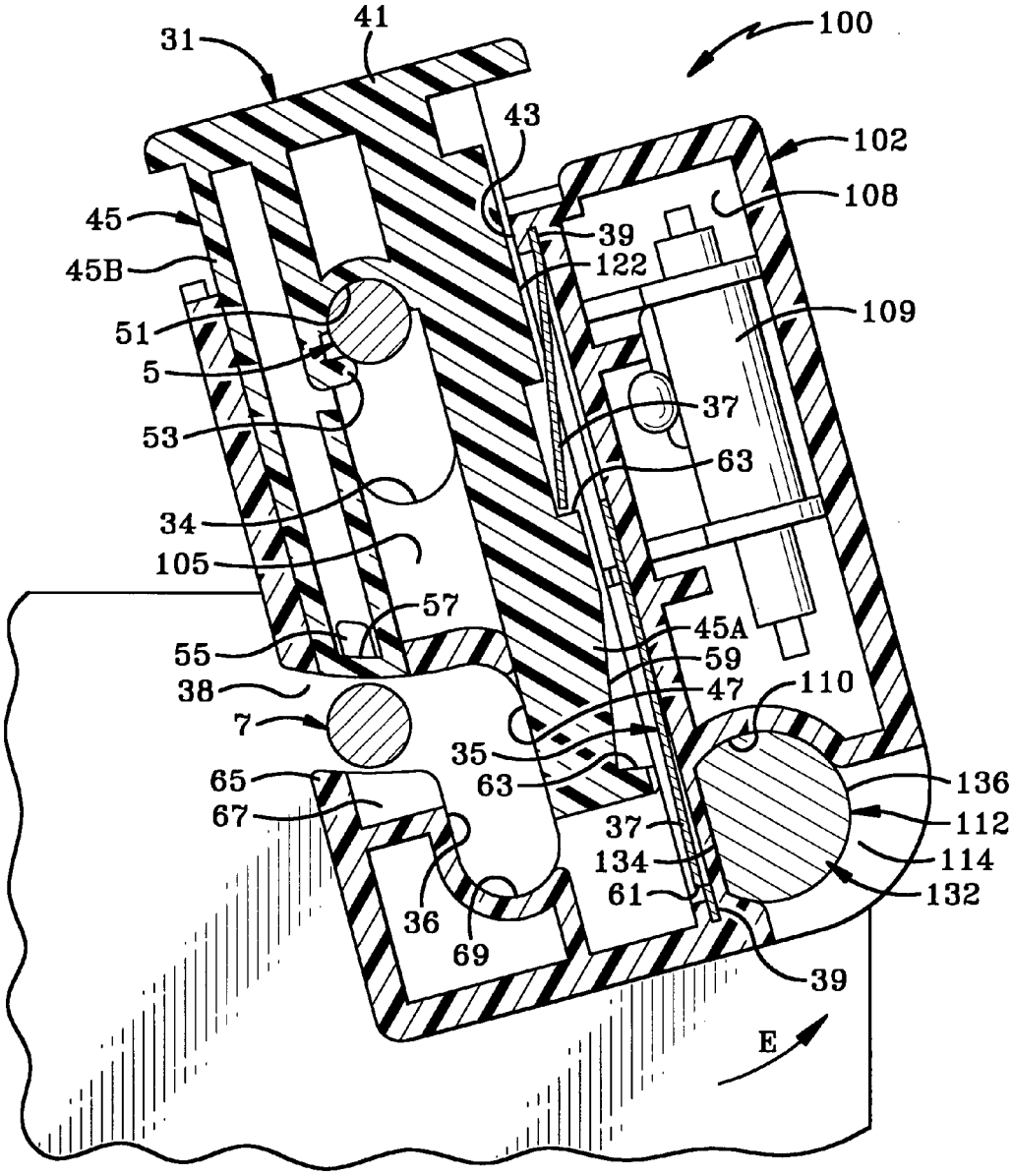
FIG. 26 is a sectional view similar to FIG. 25 showing the locking mechanism being pivoted to a disengaged position from the lower rod.

As shown in FIG. 25, the upper metal tine 37 will engage shoulder 63 to limit the movement of housing 102 with respect to bayonet 31 upon reaching the unlocked open position to provide a positive stop together with ramped projections 55.

Key housing 130 may also be formed with a groove (not shown) in the bottom wall thereof to slidably engage lower rod 7 (FIG. 23) for moving magnet 132 into recess 110 in a direction perpendicular to front surface 107 of housing 102.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A lock mechanism for attaching to a pair of vertically spaced upper and lower rods extending outwardly from a support surface for displaying and supporting an item of merchandise on said lower rod, said lock mechanism comprising:

a housing formed with an internal lock chamber and a pair of upper and lower slots, each slot adapted to receive a respective one of the rods therethrough, said lower slot having a side opening configured for allowing passage of the lower rod therethrough when the lock mechanism is in an open unlocked position and for enabling the housing to pivot on the upper rod out of engagement from the lower rod;

a locking bayonet formed with an elongated slot adapted to receive both of the rods therethrough, said bayonet being slidably mounted in the lock chamber of the housing and moveable between a locked position and the unlocked open position;

a locking device including at least one magnetically attractable tine located within the lock chamber of the housing for securing the housing and bayonet in the locked position on the pair of rods; and said bayonet blocking the side opening of the lower slot when in the locked position and exposing the side opening of said lower slot when in the unlocked open position to enable the lock mechanism to pivot about the upper rod and to enable the lower rod to move through the side opening of said lower slot to disengage the lock mechanism from the lower rod.

2. The lock mechanism defined in claim 1 wherein the housing is formed with a key receiving recess located adjacent the at least one magnetically attractable locking tine; and in which said recess has a non-circular cross-sectional configuration.

3. The lock mechanism defined in claim 2 wherein the key receiving recess has a D-shape cross-section with a flat surface and an arcuate surface; and in which the flat surface is located adjacent the at least one magnetically attractable locking tine.

4. The lock mechanism defined in claim 1 wherein the housing is formed with a security tag chamber; and in which an EAS tag is located within said security tag chamber.

5. The lock mechanism defined in claim 1 wherein the housing is formed with an open top; and in which the locking bayonet extends through said open top for slidably mounting the bayonet in the lock chamber.

6. The lock mechanism defined in claim 1 wherein a resilient tab is formed adjacent the elongated slot of the locking bayonet for snap fit engagement onto the upper rod.

7. The lock mechanism defined in claim 1 wherein a first one-way projection is formed on one of the housing and locking bayonet which engages a second projection formed on the other of the housing and locking bayonet to retain the bayonet in an assembled position in the housing.

8. The lock mechanism defined in claim 1 wherein the locking bayonet is formed with a pair of spaced elongated legs forming the elongated slot therebetween; and in which one of said legs is longer than the other of said legs, with the shorter leg blocking the side opening of the lower slot when the lock mechanism is in the locked position.

9. The lock mechanism defined in claim 8 wherein the longer leg engages the locking device tine to secure the bayonet in the locked position.

10. The lock mechanism defined in claim 9 wherein the longer leg is formed with a recess terminating in a shoulder, which shoulder engages a distal end of the locking tine to secure the bayonet in the locked position.

11. The locking mechanism defined in claim 3 wherein the key receiving recess is formed in a front surface of the housing.

12. In combination, a lock mechanism for attaching to a pair of spaced rods extending outwardly from a support surface for displaying and supporting an item of merchandise on said lower rod and a magnetic key to unlock the lock mechanism, said lock mechanism comprising:

a housing formed with an internal lock chamber and a pair of slots, each slot adapted to receive a respective one of the rods therethrough, one of said slots having a side opening configured for allowing passage of one of the rods therethrough when the lock mechanism is in an open unlocked position and for enabling the housing to pivot on the other of said rods and out of engagement from the said one rod;

a locking bayonet formed with an elongated slot adapted to receive both of the rods therethrough, said bayonet being slidably mounted in the lock chamber of the housing and moveable between a locked position and the unlocked open position;

said bayonet blocking the side opening when in the locked position and exposing the side opening when in the unlocked open position for enabling the lock mechanism to pivot about the other of said rods and for enabling the one said rod to move through the side opening for disengaging the lock mechanism from the lower rod;

a locking device including at least one magnetically attractable locking tine located within the lock chamber of the housing for securing the housing and bayonet in the locked position on the pair of rods;

a non-circular recess formed in the housing adjacent the locking tine;

the magnetic key containing a magnet having a non-circular cross-sectional configuration complementary to the housing recess for placement in said recess; and said magnet being a bipolar magnet.

13. The combination defined in claim 12 wherein the bipolar magnet has a D-shaped cross-section with a flat side and an arcuate side; and in which the flat side of the magnet aligns with the locking tine to move said tine from the locked position to the unlocked position.

14. The combination defined in claim 12 wherein the housing includes a front surface, in which the non-circular recess is accessible through the front surface of the housing.

15. The combination defined in claim 12 wherein the magnet is slidably mounted in an outer protective housing.

* * * * *